United States Patent [19]

Rylewski

[11] 4,274,814

[45] Jun. 23, 1981

[54] ROTATIVE MACHINE FOR FLUIDS

[76] Inventor: Eugeniusz M. Rylewski, 43bis, Ave. du Gal Leclerc, 78470 St. Remy les Chevreuse, France

[21] Appl. No.: 33,015

[22] Filed: Apr. 24, 1979

Related U.S. Application Data

[63] Continuation of Ser. No. 797,311, May 16, 1977, abandoned.

[30] Foreign Application Priority Data

May 17, 1976 [FR] France ..... 76 14837

[51] Int. Cl.[3] ..... F01C 1/00; F03C 2/00; F04C 2/00; F04C 18/00

[52] U.S. Cl. ..... 418/15; 418/195; 418/215; 418/226

[58] Field of Search ..... 418/15, 215, 218, 226, 418/195, 216; 123/241; 60/39.45

[56] References Cited

U.S. PATENT DOCUMENTS

| | | | |
|---|---|---|---|
| 926,731 | 7/1909 | Dowling | 418/226 |
| 1,004,696 | 10/1911 | Schoeck | 123/243 |
| 1,304,497 | 5/1919 | Maxam | 418/226 |
| 1,367,801 | 2/1921 | Clark | 418/226 |
| 2,090,280 | 8/1937 | Biermann | 418/226 |
| 3,904,331 | 9/1975 | Rylewski | 418/226 |
| 4,021,165 | 5/1977 | Rylewski | 418/226 |

FOREIGN PATENT DOCUMENTS 649412 1/1951 United Kingdom .

*Primary Examiner*—John J. Vrablik
*Attorney, Agent, or Firm*—Morgan, Finnegan, Pine, Foley & Lee

[57] ABSTRACT

Rotative machine for fluids comprising a disc or stator with spiral-like ribs limiting channels between an inlet and an outlet for fluids and, mounted for rotation in relation to the said disc, a rotor cooperating slidingly with the said disc so as to define with said channels, the conduits for the circulation of fluid, vanes of the vane wheels, with a profile conjugated with the profile of the channels and engaged in the latter, the said wheels being carried for rotation by the rotor.

The channels are extended in such a manner as to allow the conduits to be operative with a vane in the portions of the channels where the vane cooperates only with one rib.

Such a machine can be used in a gas turbine assembly.

11 Claims, 7 Drawing Figures

ROTATIVE MACHINE FOR FLUIDS

This is a continuation of application Ser. No. 797,311 filed May 16, 1977, now abandoned.

The object of this invention is a rotative machine for fluids.

It concerns driving or driven machines comprising two assemblies rotating one in relation to the other namely the stator and the rotor. The driving or driven effect is obtained by the circulation of the fluid in conduits having general form of spirales and connecting an inlet with an outlet. The conduits have a wall moving in relation to the other walls and guide the vanes of the wheels carried by the assembly having the mobile wall. The vanes circulate transversely in the conduits.

The conduits are usually formed by channels or grooves made in the first assembly and the vane wheels are carried by the second assembly and put in rotation about axes which are transverse to the axis of relative rotation of the two assemblies; the former axis not passing through the latter axis.

In what follows, it is assumed that the channels or grooves are made in a fixed assembly or stator, the vane wheels being carried by a rotative assembly or rotor. But the invention comprises machines in which the channels are made in mobile assembly and the vane wheels carried by the stationary assembly.

In such machines each vane of a vane wheel is symmetrical about a radius of the wheel. For example, it has two lateral sides cooperating with lateral surfaces of the channels or the grooves and a front side cooperating with the bottom of the grooves. In the machines proposed so far, the channels, as to the circulation of the fluid, are operative along their portions which cooperate with the portions of the vane symmetrical about the said radius; for example, with two lateral sides of the vane. A direct communication being established between the conduit and the inlet or the outlet of the channel which the lateral side of the vane leaves the wall of the channel with which it cooperates.

The object of the invention is a rotative machine for compressible or non-compressible fluids with channels or grooves and cooperating vanes being part of vane wheels characterised by the fact that a conduit, limited by the groove and cooperating surfaces of the rotor and the stator, cooperates with the vane beyond the portion of the groove which corresponds to the cooperation of the groove with the portions of the vane symmetrical about its mean radius, for example, through the lateral sides of the vane. The vane cooperates, then, with one of its lateral sides with a lateral wall of the groove and with its front side or with a portion of its front side with the bottom of the groove. The cross-section of the conduit is thus fairly triangular and its surface is rapidly increasing or decreasing as the portion of the front side of the vane cooperating with the groove decreases or increases.

Not only the channels of a stator are utilised better i.e. their operative length is increased, but also, the relatively rapid variation of the cross-section of the ending compartments of the conduit is utilised advantageously to increase the effect of compression or expansion.

Further, the sliding cooperation of a vane with the surface of a groove by only a portion of its edge or side, reduces the friction.

Also, it is possible to build machines with a small number of grooves, as small as two, with a small number of vane wheels, and with a small number of vanes for each vane wheel.

The increased operative length of each groove allows the groove to be used for several functions with a particular advantage when the machine for fluids is utilised as a heat pump or a gas turbine.

The invention provides for a structure in which the rotor, the wheels of which have a small number of vanes, is bordered by two stators with small number of grooves, which contributes to a positive link between the rotor and the stators; a vane wheel cooperating either through one vane with one stator or through two vanes with the first and the second stators.

The description which follows, made as an example, is made with reference to the accompanying drawings, in which.

Figure 1:
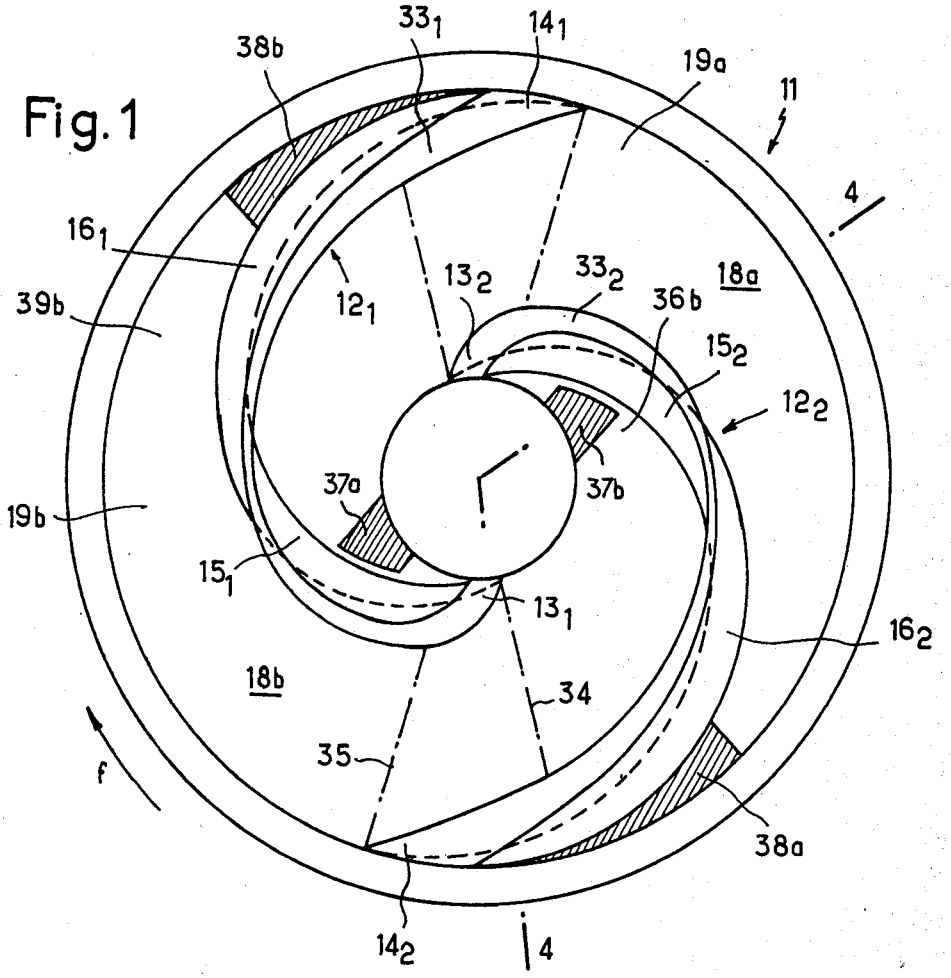
FIG. 1 is a schematic front view of a stator.

In the structure shown on FIG. 1 the stator comprises a body 11 to which belong two ribs $12_1$, $12_2$ spiral-like in shape. The central extremities $13_1$, $13_2$ of the ribs are diametrally opposite as also are the peripheral extremities $14_1$ and $14_2$.

Figure 2:
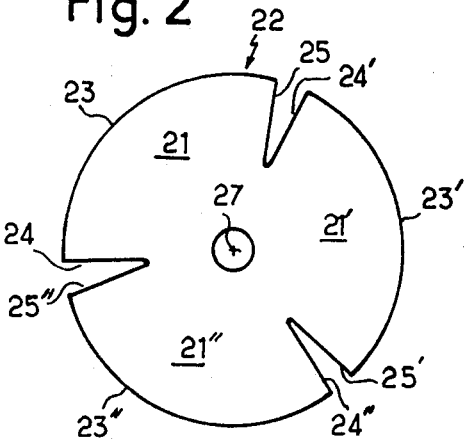
FIG. 2 is a view of a vane wheel.
Figure 3:
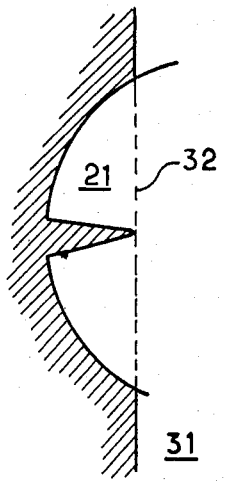
FIG. 3 is a schematic view of a portion of the machine, in axial section.
Figure 4:
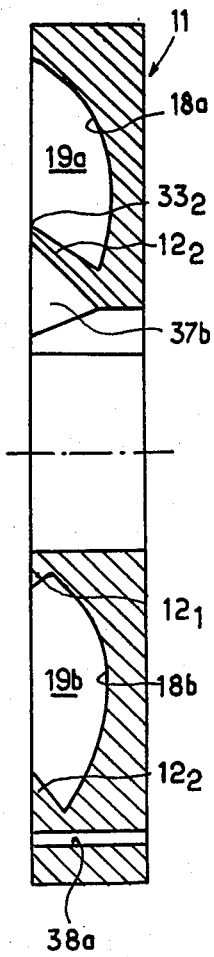
FIG. 4 is a view in section along line 4—4 of FIG. 1.

Each rib comprises an internal lateral flank $15_1$, $15_2$ respectively and an external lateral flank $16_1$, $16_2$ respectively. A channel or groove **19*b* is limited by an internal flank of a rib, for example $15_2$, by an external flank of the other rib, in that case $16_1$ and by a bottom 18*b*. The other channel 19*a* is limited by the internal flank $15_1$ of the rib $12_1$ and the external flank $16_2$ of the rib $12_2$. In a channel or groove 19*a* or 19*b* circulates a vane 21 of a vane wheel 22 (FIG. 2). The latter comprises, in the structure described, three vanes 21,21',21'', limited, each of them, by a front side 23, circular, and by two lateral sides 24 and 25**, fairly radial; the interval between two successive vanes being small.

The vane wheels 22 are carried by the rotor 31 the face 32 of which faces the stator 11. The said face, from which protrude vanes 21, is flat and cooperates slidingly with the top edges $33_1$ and $33_2$ flat correspondingly, of the ribs $12_1$ and $12_2$ so as to define the conduits for the circulation of the fluid.

FIG. 1 shows by half dotted lines 34 and 35 the portion of the channel **19*b* in which a vane 21 cooperates simultaneously by its lateral sides 24 and 25 and by its front side 23 with, respectively, the internal face $15_2$ of the rib $12_2$, the external face $16_1$ of the rib $12_1$ and the bottom 18*b***.

When the rotor 31 moves, for example, in the direction shown by the arrow f, the vane 21 has, before reaching this zone, a side 25 free i.e. not in contact with the external surface $16_1$ of the rib $12_1$. The said vane cooperates by its front side 23 with the portion **36*b* of the bottom 18*b*, torus-like in shape with a cross-section conjugated with the cross-section of the front side 23, and with the internal surface $15_2$ of the rib $12_2$. In the portion 36b of the bottom 18b, at the origin of the latter, is provided a port for the fluid shown in 37b**.

In another structure, a vane wheel is not placed in a radial plane of the rotor and the surface of the stator with which it cooperates, although still of revolution, is not of torus shape.

The vane 21 is operative through the cooperation of the increasing length of its front side 23 during the rotation of the rotor. This is so until the vane reaches the limit 34 from which its side 25 becomes operative as well. When the vane circulates in the groove 19b between the radial limit planes 34 and 35 it is operative as well by its front side as by its lateral sides.

When the vane passed the radial limit plane 35, it is its lateral side 24 which becomes inoperative, the vane being, however, operative not only by its opposite lateral side 25 which cooperates with the external surface $16_1$ of the rib $12_1$, but also by its front side 23 which cooperates with the conjugated bottom 19b, torus-like in shape. The last cooperation takes place along a decreasing length, and up to the output port 38b made in the portion 39b of the bottom 19b where the compartment for fluid is relatively narrow.

In the same manner, the channel or groove 18a has a fluid port 37a at one of its extremities, and a fluid port 38a at the other extremity.

The invention covers also the machines in which the vanes have a contour incurved from one extremity to the other, for example, in the shape of a circular arc which does not permit to distinguish a front side and lateral sides.

Figure 5:
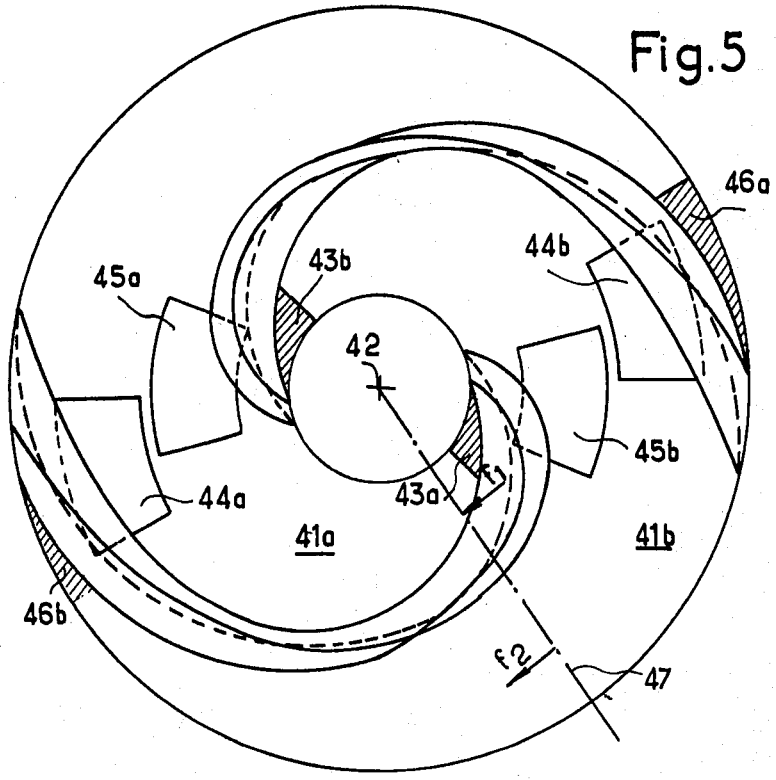
FIG. 5 is a view similar to FIG. 1 but for another structure.

Reference is now made to FIG. 5. In this structure, the channel or groove 41a has at its central extremity i.e. the closest to the axis 42 of relative rotation between the stator and the rotor, a first port 43a. The channel has, in the intermediate zone of its length, a second port 44a and a third port 45a the portion of which is radially aligned with a portion of the second port 44a. The channel 41a has, at its peripheral extremity, a port 46a. In the same manner, the other channel 41b has four ports for fluid, respectively 43b, 44b, 45b and 46b.

A machine comprising such a stator cooperating with a rotor carrying vane wheels, is advantageously utilisable in a gas turbine assembly. The ports 43a and 43b are used for the introduction of hot gases coming, under pressure, from the combustion chamber. The ports 44a and 44b allow the exhaust of the gases after the expansion. The air is admitted, under slight pressure, through the ports 45. This air is destined to be compressed by the vanes of the vane wheels during the second part of their travel in the conduits. It is used simultaneously for the scavenging of the gases resulting from the expansion. The action of the centrifugal force can also contribute to the scavenging. The air put under pressure in the second part of the channels is discharged through ports 46 towards the combustion chamber.

In the arrangement shown on FIG. 5, a vane of a vane wheel, as it can be seen in dotted line 47, receives on its portion housed in the channel 41a the thrust effort of the gases under pressure, as shown by the arrow $f_1$. By its portion housed in the channel 41b, it pushes and puts the air under pressure, as shown by the arrow $f_2$. It is therefore, in the best conditions from the point of view of the balance of thrusts on a wheel, taking into consideration the mounting of the wheel in the slot of the rotor.

A similar arrangement is provided for the composition of a heat pump.

Figure 6:
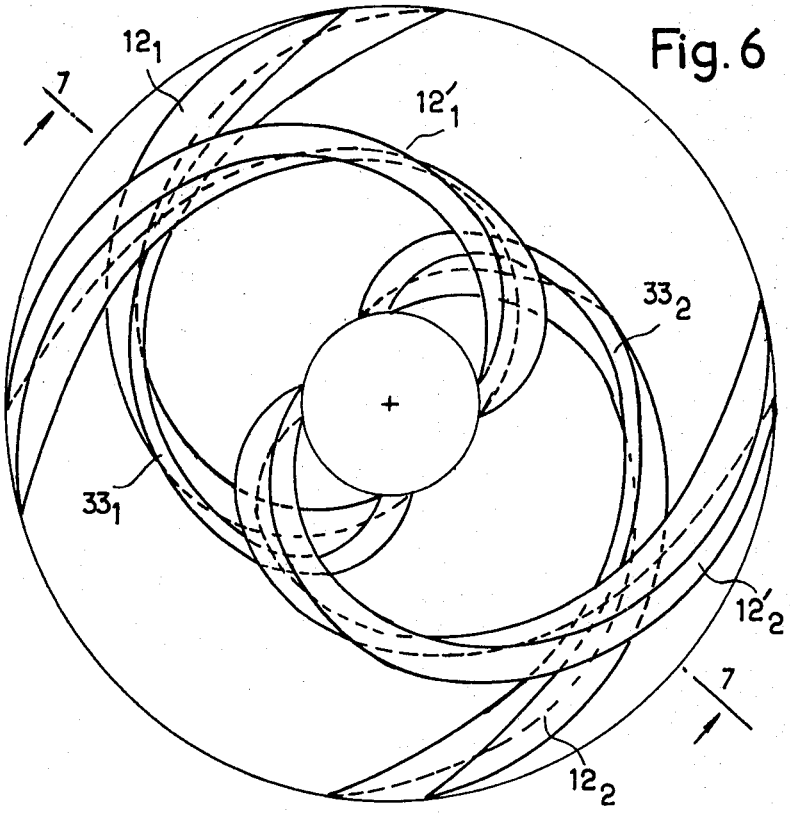
FIG. 6 is a schematic view of a machine with two stators cooperating with one rotor, the rotor being supposed to be taken away and the bottom of the stator close to the observer being supposed transparent.
Figure 7:
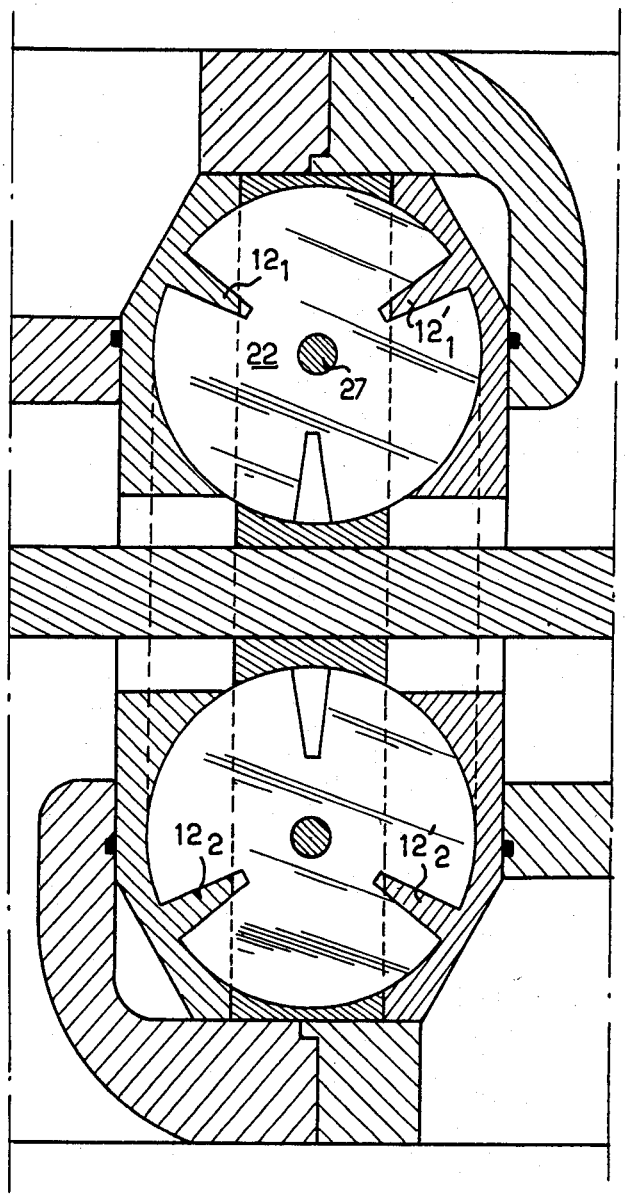
FIG. 7 is a view in section along line 7—7 of FIG. 6, but the rotor being represented.

The machine shown in FIGS. 6 and 7 comprises two stators as described above. The bottom of the stator placed closer to the observer has been supposed to be transparent. These stators are placed on both sides of a rotor not represented here. From both opposite faces of the rotor protrude vane wheels ready to cooperate, on one side, with the channels of the first stator and, on the other side, with the channels of the second stator. The latter are angularly displaced in relation to the channels of the first stator so as to correspond with the arrangement of the vane wheels with the vanes of a vane wheel. Thus, a vane wheel can cooperate simultaneously with the two stators.

In a structure where a vane wheel cooperates through one of its vanes with one rotor and through another vane with the other rotor, the thrust exerted on a wheel equals the difference of the thrusts resulting from the expansion and from the compression.

The invention applies also to the machines for fluids in which the stator and the rotor comprise non-flat cooperating surfaces sliding one on the other.

I claim:

1. In a positive-displacement machine in which the conversion of pressure energy of fluids is obtained by the circulation of at least two spaced vane members in at least one spiral-like passage of revolution defined by a pair of rib members having top surfaces and side walls and a bottom wall therebetween, wherein said vane members are parts of at least two vane wheels, each of said vane wheels is mounted for rotation about its own axis and housed in a slot formed in a first part of said machine, said vane members circulating in said spiral-like passages of revolution formed in a second part of said machine, at least one of said first and second parts of said machine is rotatable, the axis of rotation thereof constituting the main axis of rotation of said machine, said spiral-like passages of revolution are generated by a combined rotation of said vane members about the axis of rotation of their respective vane wheels and by rotation of said first part of said machine in relation to said second part of said machine, said spiral-like passages are closed across the top of said side walls by a surface of revolution formed on said first part of said machine housing said vane wheels, said surface of revolution formed on said first part of said machine cooperating with a conjugated surface of revolution formed on said top surfaces of said ribs defining said passages on said second part of said machine, said defined spiral-like passages of revolution having an inlet and an outlet and a continuous progressively varying cross-sectional area from the inlet to the outlet thereof, each of said surface of revolution and said conjugated surface of revolution being generated about said main axis of rotation of said machine, whereby the ratio and the gradient of compresson or expansion for a compressible fluid, and the constant volume flow for an incompressible fluid, flowing through said passages between said two spaced vane members circulating therein are imposed by the relative position and configuration of said cooperating conjugated surface of revolution to said surface of revolution generated by the rotation of said vane members about said main axis of said machine and by the difference of the distances of said vane members from said main axis of said machine during their travel from the inlet to the outlet of said spiral-like passages, the improvement therein which comprises:

said at least one spiral-like passage of revolution having an extended operative portion which is defined by said bottom wall and by a single one of said pairs of rib members, and said conversion of pressure energy of fluids takes place in the portion of said spiral-like passage of revolution bordered by said one rib member as well as in the portion thereof bordered by said pair of rib members.

2. A machine as claimed in claim 1, wherein the contour of each of said vane members comprises two lateral sides and a front side, and said extended operative portion of said spiral-like passage of revolution has a lateral side of a vane member cooperating with a lateral surface bordering said passage.

3. A machine as claimed in claim 1, wherein the radial section of said extended portion of said spiral-like passage of revolution has two sides.

4. A machine as claimed in claim 1, wherein said bottom wall of said spiral-like passage of revolution extends between said one rib member and a terminal point, the bottom wall terminal point and the top surface of said one rib member being closed by said surface of revolution formed on said first part of said machine housing said vane wheels.

5. A machine as claimed in claim 4, wherein the cross-section of said spiral-like passage of revolution is generally triangular in shape.

6. A machine as claimed in claim 4, wherein said bottom wall extends curvilinearly from the base of said one rib member to said terminal point, and wherein the cross-section of said spiral-like passage of revolution is generally triangular in shape.

7. A machine as claimed in claim 1, wherein said fluid enters and leaves the machine through ports formed in the bottom wall of said passage of revolution at the central and peripheral extremities of said machine, and wherein the peripheral extremity port is located in a portion of said passage of revolution where the radial section has two sides.

8. A machine as claimed in claim 7, including third and fourth ports formed in the bottom wall of said passage of revolution intermediate said central extremity port and said peripheral extremity port, whereby a compressed fluid admitted at said central extremity port is expanded over a first portion of said spiral-like passage of revolution and thereafter evacuated at said third port and a fluid admitted at said fourth port is compressed over a second portion of said spiral-like passage of revolution and thereafter evacuated through said peripheral extremity port, the pressure exerted by the fluid on said vane used for compression being subtracted from the pressure exerted on a neighboring vane used for expansion, both vanes being part of the same vane wheel.

9. A machine as claimed in claim 8, in which the evacuation of the expanded fluid from said spiral-like passage of revolution is assured by supplying the fluid to be compressed at a slightly higher pressure.

10. A machine as claimed in claim 8, in which the intermediate discharge third port for the expanded fluid and the intermediate inlet fourth port for the fluid to be compressed are aligned substantially radially at the bottom of said spiral-like passage of revolution so that the centrifugal force empties the expanded fluid through the intermediate discharge port and admits the new charge of fluid for compression through the intermediate inlet port.

11. A machine as claimed in claim 8, wherein at least one spiral-like passage of revolution is also formed in a third part of said machine identical to that formed on said passage of revolution formed in each of said secparts of said machine each facing opposite sides of said first part of said machine carrying said vane wheels, and wherein said vane wheels simultaneously independently cooperate through diametrically opposed portions with said passage of revvolution formed in each of said second and third parts of said machine, whereby the pressure exerted by fluid circulating in the compression portion of said passage against said vanes is in the same direction on each side of said first part of said machine, and the pressure exerted by fluid circulating in the expansion portion of said passage against said vanes is in the opposite direction on each side of said first part of said machine, so that said vane wheels operate as thrust bearings on said first part of said machine, the thrust on the vane wheels being the difference between the thrust resulting from the compression and from the expansion of the fluids in the machine.

* * * * *

UNITED STATES PATENT AND TRADEMARK OFFICE

CERTIFICATE OF CORRECTION

PATENT NO. : 4,274,814

DATED : June 23, 1981

INVENTOR(S) : Eugeniusz M. Rylewski

It is certified that error appears in the above—identified patent and that said Letters Patent is hereby corrected as shown below:

In Col. 6, Claim 11, line 4 should read as follows:
-- said second part of said machine, said second and third --.

Signed and Sealed this

*Twenty-seventh* Day of *October 1981*

[SEAL]

*Attest:*

GERALD J. MOSSINGHOFF

*Attesting Officer*

*Commissioner of Patents and Trademarks*